US006817737B2

(12) United States Patent
Romano et al.

(10) Patent No.: US 6,817,737 B2
(45) Date of Patent: Nov. 16, 2004

(54) LIGHT PROJECTOR

(75) Inventors: Richard Romano, Murrietta, CA (US); Robert Fry, Idyllwild, CA (US); Wallace Daniels, Palo Cedro, CA (US)

(73) Assignee: Morpheous Technologies, LLC, New York, NY (US)

( * ) Notice: Subject to any disclaimer, the term of this patent is extended or adjusted under 35 U.S.C. 154(b) by 0 days.

(21) Appl. No.: 10/038,521

(22) Filed: Oct. 19, 2001

(65) Prior Publication Data

US 2002/0159262 A1 Oct. 31, 2002

Related U.S. Application Data

(60) Provisional application No. 60/242,394, filed on Oct. 20, 2000.

(51) Int. Cl.[7] ..... F21V 9/00

(52) U.S. Cl. ..... 362/293; 362/233; 362/268; 362/281

(58) Field of Search ..... 362/293, 233, 362/268, 281, 283, 284, 319–324

(56) References Cited

U.S. PATENT DOCUMENTS 4,797,795 A * 1/1989 Callahan ..... 362/233
4,855,884 A 8/1989 Richardson ..... 362/278
4,891,738 A 1/1990 Richardson et al. ..... 362/282
4,914,556 A 4/1990 Richardson ..... 362/293
5,665,305 A * 9/1997 Belliveau et al. ..... 362/268
5,980,066 A * 11/1999 Belliveau et al. ..... 362/281

* cited by examiner

*Primary Examiner*—Stephen Husar
*Assistant Examiner*—James Cranson
(74) *Attorney, Agent, or Firm*—Davidson, Davidson & Kappel, LLC

(57) ABSTRACT

A light projector is provided which includes an elliptical reflector, a first spherical retro-reflector, the first retro-reflector having an first aperture formed therein, the first aperture having a first diameter and a first center-point, a second spherical retro-reflector located between the elliptical reflector and the first retro-reflector, the second retro-reflector having a second aperture formed therein, the second aperture having a second diameter and a second center-point, the second diameter smaller than the first diameter, the first and second center-points lying along a common axis, and a light source, the light source located at a foci of the elliptical reflector, the light source lying along the common axis, the elliptical reflector reflecting light emitted by the light source, the reflected light passing through the first and second apertures, the first and second retro-reflectors being positioned so as to reflect light emitted by the light source back towards the light source. Also provided is a light projector that includes a light source projecting a beam of light; and an optical element movable between a first position in which the beam of light does not impinge upon the optical element, a second position in which substantially all of the beam of light impinges upon the optical element, and a plurality of intermediate positions in which a portion of the beam of light impinges upon the optical element, wherein the optical element is comprised of a plurality of radially sectioned sub-elements.

31 Claims, 13 Drawing Sheets

LIGHT PROJECTOR

This application claims priority from U.S. Provisional Application Ser. No. 60/242,394, filed Oct. 20, 2000, and entitled "Light Projector", the entire disclosure of which is hereby incorporated by reference.

FIELD OF THE INVENTION

The present invention relates to the field of light projectors.

BACKGROUND OF THE INVENTION

Automated light projectors are known in the art, and are used in a variety of applications including theatrical productions, television productions, musical performances, and architectural lighting.

In general, these automated light projectors are designed to allow a user to vary one or more lighting parameters from a remote location via lighting control console. These lighting parameters may include, for example, pan, tilt, intensity, beam size, beam shape, and color. For example, U.S. Pat. No. 4,914,556 describes a color mixing system, U.S. Pat. No. 4,855,884 describes a mechanism for varying beam size, and U.S. Pat. No. 4,891,738 describes a mechanism for varying beam shape.

SUMMARY OF THE INVENTION

In accordance with a first embodiment of the present invention, a light projector is provided which includes an elliptical reflector, a first spherical retro-reflector and a second spherical retro-reflector. The first retro-reflector has a first aperture formed therein, and the first aperture has a first diameter and a first center-point. The second spherical retro-reflector is located between the elliptical reflector and the first retro-reflector, and the second retro-reflector has a second aperture formed therein, and the second aperture has a second diameter and a second center-point, wherein the second diameter smaller than the first diameter and the first and second center-points lie along a common axis. The light projector also includes a light source located at a foci of the elliptical reflector. The light source (e.g., the arc gap of a gas discharge lamp) lies along the common axis, and the elliptical reflector reflects light emitted by the light source so that the reflected light passes through the first and second apertures. The first and second retro-reflectors are positioned so as to reflect light emitted by the light source back towards the light source. In this manner, light which was not initially directed to the elliptical reflector from the light source is redirected to the light source by the first or second retro-reflectors, passes through the light source to the elliptical reflector, and is reflected back through the first and second apertures.

Preferably, the elliptical reflector, the first retro-reflector, and the second retro-reflector are each comprised of a base portion which is heat conductive, and the base portion has a coating applied thereto which reflects visible light and absorbs infra-red light. The base portion of each of the elliptical reflector, the first retro-reflector, and the second retro-reflector, in turn, is in contact with a heat sink. In this manner heat generated by the light source is dissipated through the heat sink. In certain embodiments, this allows the light projector to operate without any fans. Preferably, the base portion is made of polished, hard anodized aluminum, the coating is a dielectric coating, and the heat sink is constructed as a plurality of heat sink fins. The light projector in accordance with this embodiment may also include other components, including, for example, a color changing apparatus, a beam shaping apparatus, and a yoke for moving the light projector in a panning (e.g. horizontal rotation) or tilting (e.g. vertical rotation) movement.

In accordance with a second embodiment of the present invention, a light projector is provided which includes a light beam source for projecting a beam of light along an axis and a beam shaping apparatus disposed along the axis. The light beam source can be of any construction, including, for example, any conventional light source and reflector arrangement. The beam shaping apparatus includes a first beam shaping wheel and a second beam shaping wheel. The first beam shaping wheel has a first plurality of apertures disposed about its periphery, and at least one of said apertures has a first cylindrical lens disposed therein. The second beam shaping wheel has a second plurality of apertures disposed about its periphery, and at least one of said apertures having a second cylindrical lens disposed therein. The first beam shaping wheel is rotatable to selectively pass each of the first plurality of apertures through the axis and the second beam shaping wheel is rotatable to selectively pass each of the second plurality of apertures through the axis. Preferably, the first and second beam shaping wheels are independently rotatable. In accordance with a further aspect of this embodiment, each of the first and second cylindrical lenses is rotatable within its respective aperture. Preferably, each beam shaping wheel includes at least two cylindrical lenses having different focal lengths. For example, the first beam shaping wheel might include one empty aperture, one aperture with a cylindrical lens with a 100 mm focal length and another aperture with a cylindrical lens with a 150 mm focal length. The second beam shaping wheel could include the same arrangement. Then, by selectively moving lenses from one or both of the first and second beam shaping wheels into the axis, a variety of shapes can be generated. The beam shaping arrangement of the second embodiment may also be used as a beam shaping apparatus for the first embodiment of the present invention described above.

In accordance with a third embodiment of the present invention, an automated lighting fixture is provided which includes a light projector including a light beam source disposed within a housing, a yoke, and a base. The base includes a first motor for rotating the yoke in a horizontal plane. The yoke includes a pair of vertically extending arms coupled to the housing, and the light projector is rotatably secured to the vertically extending arms so that the light projector is movable radially about an axis passing through the vertically extending arms. The yoke also includes a horizontally extending member which joins the vertically extending arms. The horizontally extending member has a length and width which is substantially equal to the length and width of the base. This allows the use of larger bearings for rotating the yoke in the horizontal plane. Preferably, the housing, the base, and the yoke are fabricated from a carbon fiber composite material.

In accordance with another embodiment of the present invention, a light projector includes a light source, a reflector for reflecting light from the light source into a beam of light, the reflector having a base portion which is heat conductive, and having a coating applied thereto which reflects visible light and absorbs infra-red light. A heat sink in contact with the base portion. Preferably, the base portion is made of polished, hard anodized aluminum, the coating is a dielectric coating, and the heat sink is constructed as a plurality of heat sink fins. The reflector can be of any conventional shape depending on the particular application. Examples of suitable reflectors include spherical reflectors, elliptical reflectors, and parabolic reflectors.

In accordance with another embodiment of the present invention, a light projector includes a light beam source for projecting a beam of light along an axis, a strobe wheel disposed between the first retro-reflector and the lens, and a motor coupled to the strobe wheel. The strobe wheel includes a plurality of apertures disposed about its periphery, and is rotatable by the motor so that the plurality of apertures successively pass through the axis. In this manner, a strobe effect can be produced while moving the motor in only one direction, as contrasted with prior art flag-type systems in which the direction of rotation of the motor must be repeatedly reversed.

In accordance with another embodiment of the invention, a wash light is provided which includes a light beam source for projecting a beam of light along an axis and a beam shaping apparatus disposed along the axis. As one of ordinary skill in the art will appreciate, a wash light is a light that is not capable of creating a focused image. In accordance with this embodiment, the light beam source can be of any construction, including, for example, any conventional light source and reflector arrangement. The beam shaping apparatus includes a first beam shaping wheel and a second beam shaping wheel. The first beam shaping wheel has a first plurality of apertures disposed about its periphery, and at least one of said apertures has a first asymmetrical lens disposed therein. The second beam shaping wheel has a second plurality of apertures disposed about its periphery, and at least one of said apertures having a second asymmetrical lens disposed therein. Preferably, the asymmetrical lenses are cylindrical lenses. The first beam shaping wheel is rotatable to selectively pass each of the first plurality of apertures through the axis and the second beam shaping wheel is rotatable to selectively pass each of the second plurality of apertures through the axis. Preferably, the first and second beam shaping wheels are independently rotatable. In accordance with a further aspect of this embodiment, each of the first and second lenses is rotatable within its respective aperture. Preferably, each beam shaping wheel includes at least two cylindrical lenses having different focal lengths. For example, the first beam shaping wheel might include one empty aperture, one aperture with a cylindrical lens with a 100 mm focal length and another aperture with a cylindrical lens with a 150 mm focal length. The second beam shaping wheel could include the same arrangement. Then, by selectively moving lenses from one or both of the first and second beam shaping wheels into the axis, a variety of shapes can be generated. It should be noted that additional beam shaping wheels may also be included in the beam shaping apparatus. The beam shaping arrangement of this embodiment may also be used as a beam shaping apparatus for the first embodiment of the present invention described above.

In accordance with another embodiment of the present invention, a light projector is provided that includes a light source projecting a beam of light and an optical element. The optical element is movable between a first position in which the beam of light does not impinge upon the optical element, a second position in which substantially all of the beam of light impinges upon the optical element, and a plurality of intermediate positions in which a portion of the beam of light impinges upon the optical element, wherein the optical element is comprised of a plurality of radially sectioned sub-elements.

In accordance with another embodiment of the present invention, a light projector is provided that includes a light source projecting a beam of light and a plurality of optical sub-elements. Each optical sub-element is movable between a first position in which the beam of light does not impinge upon the optical sub-element, a second position in which substantially all of the beam of light impinges upon the optical sub-element, and a plurality of intermediate positions in which a portion of the beam of light impinges upon the optical sub-element.

In accordance with another embodiment of the present invention, a light projector is provided that includes a light source projecting a beam of light and a plurality of optical sub-elements, and a base. The base has an opening formed therein and the beam of light is positioned to pass through the opening. Each optical sub-element is movable between a first position in which the beam of light does not impinge upon the optical sub-element, a second position in which substantially all of the beam of light impinges upon the optical sub-element, and a plurality of intermediate positions in which a portion of the beam of light impinges upon the optical sub-element.

In accordance with further aspects of the present invention, methods for operating the embodiments described above are also provided.

BRIEF DESCRIPTION OF THE DRAWINGS

FIG. 1(*b*) is a cross-section A—A through FIG. 1(*a*).

FIG. 2(*b*) is a cross-section B—B through FIG. 2(*a*).

FIG. 7(*b*) illustrates a second lens carrying wheel for the light projector of FIGS. 1(*a*) through 5.

DETAILED DESCRIPTION OF THE PREFERRED EMBODIMENTS

The preferred embodiments of the present invention will now be described in detail with reference to FIGS. 1 through 11. Although the system of the present invention will be described in connection with these preferred embodiments and drawings, it is not intended to be limited to the specific form set forth herein, but on the contrary, it is intended to cover such alternatives, modifications, and equivalents, as can be reasonably included within the spirit and scope of the invention as defined by the appended claims.

Figure 1A:
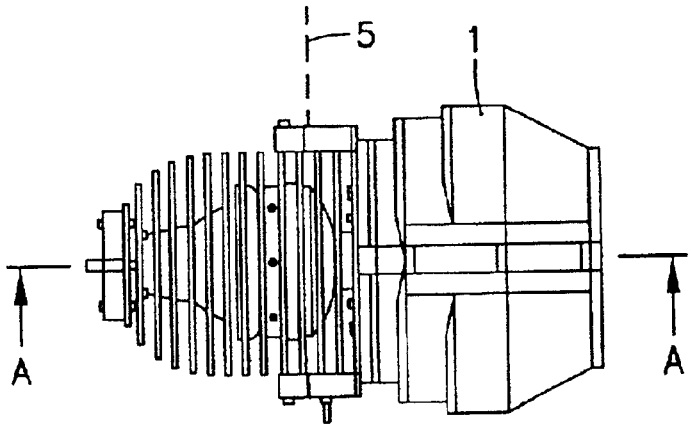
FIG. 1(*a*) is a top view of a light projector in accordance with a preferred embodiment of the present invention.
Figure 2A:
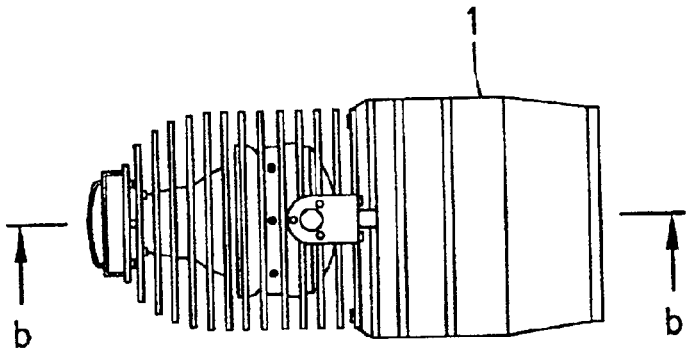
FIG. 2(*a*) is a side view of a light projector of FIGS. 1(*a–b*).
Figure 1B:
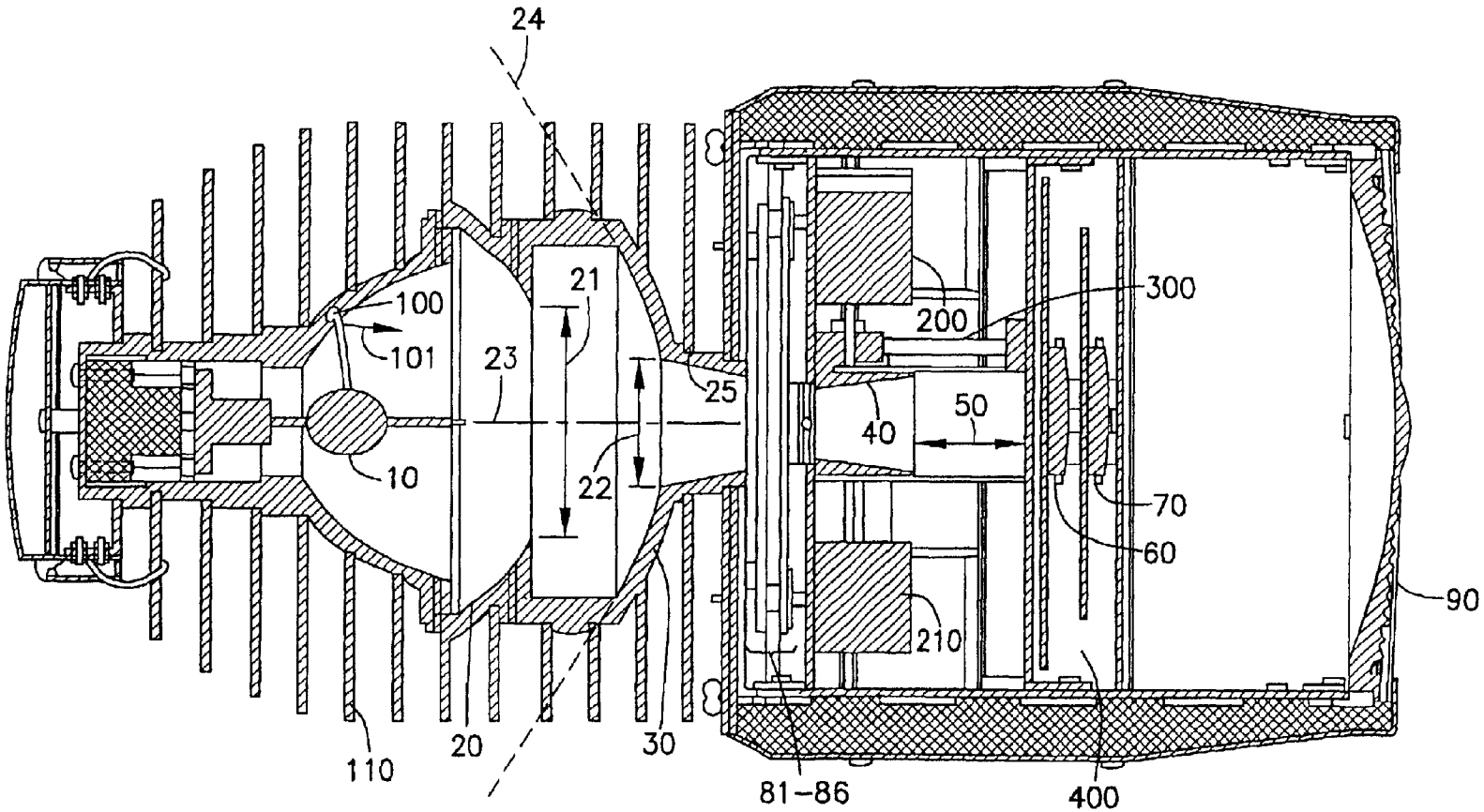
Figure 2B:
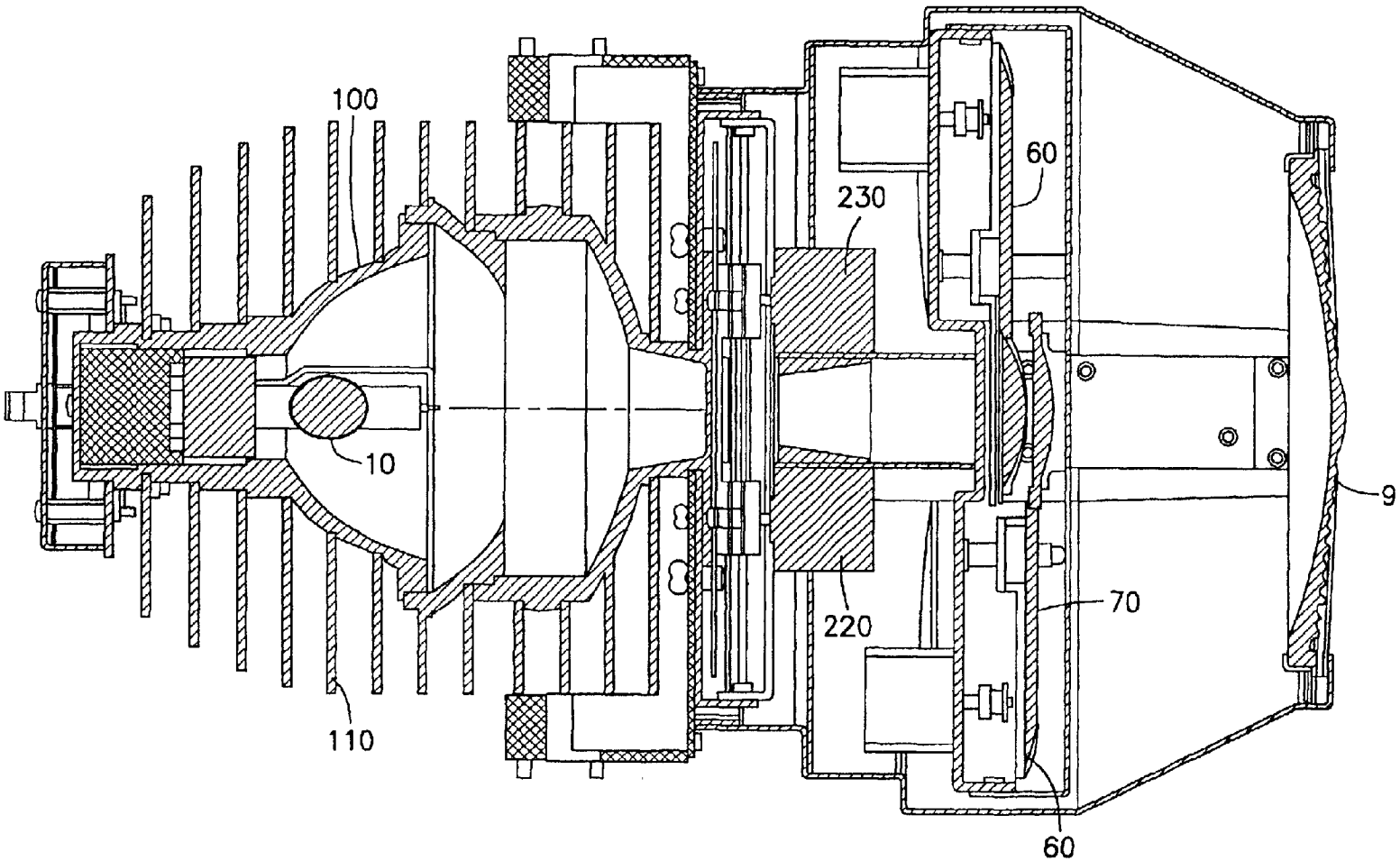

FIG. 1(*a*) shows a top view of a light projector 1 in accordance with a preferred embodiment of the present invention. FIG. 1(*b*) shows a cross-section through FIG. 1(*a*) along the line A—A indicated on FIG. 1(*a*). The light projector 1 is a wash light, and includes a lamp 10 which transmits a beam of light through a fresnel lens 90. The lamp 10 is preferably a short arc HMI source, which has its arc gap positioned at one foci of an elliptical reflector 100. The elliptical reflector 100 includes an elliptical base which is preferably machined of aluminum. A dielectric coating can be deposited on the aluminum base to form the elliptical reflector 100. The dielectric coating reflects the visible light emitted from the lamp 10 towards the optical system 120. In addition, the dielectric coating absorbs infra-red radiation emitted by the lamp 10, which radiation heats the aluminum base. This heat is then transferred to the heat sink fins 110 and then the air surrounding the projector through radiation, convection, and conduction. In alternative embodiments of the present invention, the dielectric coating may absorb other types of non-visible light such as UV light. Moreover, the aluminum may be treated, e.g., anodized, electroplated, metalized.

The projector 1 also includes a first retro-reflector 20 and a second retro-reflector 30. Retro-reflectors 20 and 30, like reflector 100, include a dielectric coating over an aluminum base which serves to reflect visible light, and to absorb infra-red light. However, the first and second retro-reflectors are spherical in shape. As with reflector 100, the infra-red light absorbed by reflectors 20 and 30 heats the underlying aluminum base, is transferred to adjacent heat sink fins 110 and then the air surrounding the projector through radiation, convection and conduction. The shapes of the first and second retro-reflectors 20 and 30 are selected so that light reflected off of the reflectors 20 and 30 is directed back to the arc gap of the lamp 10. The light passes through the lamp 10 and is reflected off of the reflector 100 towards the optical system 120. Referring to FIG. 1(*b*), the first retro-reflector 20 will reflect any visible light falling outside of a circle having a diameter 21 and a center-point 23 (dashed line), whereas second retro-reflector 30 will reflect any visible light falling outside of a circle having a diameter 22 and a center-point 23. As illustrated, diameter 22 is smaller than diameter 21. It should be noted that by utilizing a pair of retro-reflectors, the overall diameter of the projector can be reduced. Specifically, dashed line 24 illustrates the size of a single retro-reflector which would capture the same amount of energy as the dual retro-reflectors 20 and 30. In certain embodiments of the present invention, however, a single retro-reflector may nevertheless be used.

Figure 3:
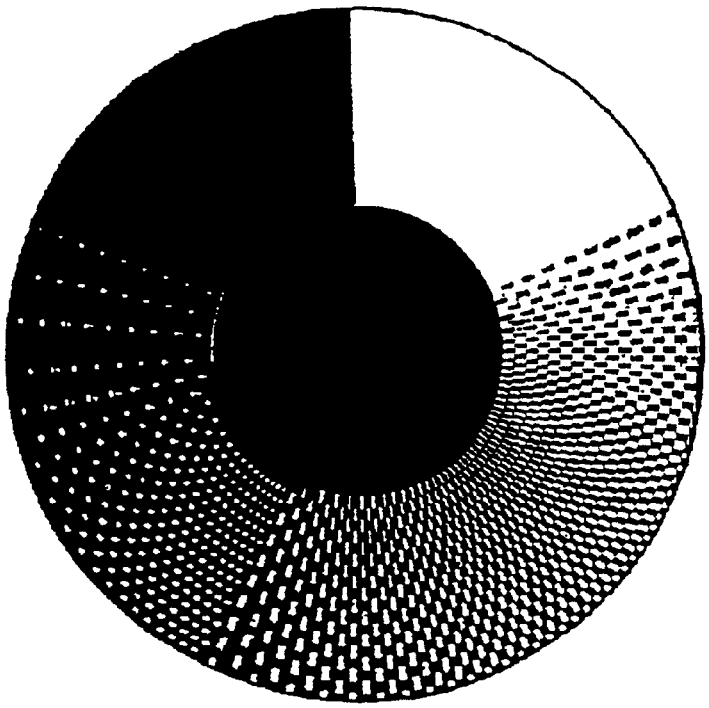
FIG. 3 illustrates a color wheel in accordance with the present invention.

Light which passes through the central passage 25 leading from retro-reflector 30 enters a color system 80. The color system 80 includes a Cyan color wheel 81, a Yellow color wheel 82, a Magenta color wheel 83, and a variable color temperature wheel 86, which are of conventional construction. Exemplary cyan, magenta, and yellow color wheels which can be used in accordance with the present invention can be found, for example, in the PC SPOT lighting projector manufactured by Morpheus Technologies, LLC, and are described, for example, in U.S. Pat. No. 4,914,556 (the '556 patent), which is hereby incorporated by reference. The color temperature wheel 86 can be fabricated in the same manner. A particularly preferred color wheel is illustrated in FIG. 3, and corresponds to FIG. 5 of the '556 patent. Color system 80 further includes a strobe wheel 84. Referring to FIG. 6 of the present application, strobe wheel 84 is comprised of an aluminum disc 845 having four apertures 841–844 radially displaced about its periphery. By rotating the strobe wheel about its axis 845, the light passing though the central passage is either allowed to pass through one of the apertures 841–844, or is blocked by the disc 845. A strobe or flashing effect can then be generated by rotating the strobe wheel 84 in one direction via a motor. This allows the projector 1 to achieve higher strobe rates than conventional "flag" type strobe systems in which the motor needs to be stopped and reversed. The color system 80 also includes a conventional dimmer wheel 85. The wheels 81–86 are independently driven by six motors, four of which (200, 210, 220, 230) are shown in FIGS. 1(*a*) and 1(*b*). The remaining two motors are mounted perpendicular to motors 220 and 230 (i.e. perpendicular to the page so that the four motors are separated by 90 degrees from each other) and therefore are not visible in FIG. 1(*b*).

After exiting the color system 80, the light enters a translating light pipe 40. The light pipe 40 is comprised of a tapered aluminum tube which is movable via a motor (not shown) on along guide-rail 300 in the direction indicated by arrow 50. As one of ordinary skill in the art will appreciate, the tapered shape of the pipe 40 causes the projected image to become smaller as the pipe moves towards the lens 90, and larger as the pipe 40 moves towards the light source 10.

Light exiting the pipe 40 enters a beam shaping system 400 which includes a pair of lens carrying wheels 60 and 70. Referring to FIGS. 6(*a*) and 6(*b*), lens carrying wheel 60 is comprised of an aluminum disc 605 having apertures 601, 603, 604, and 606 formed therein, and lens carrying wheel 70 is comprised of an aluminum disc 705 having apertures 701, 703, 704, and 706 formed therein. At least one, and preferably two or more of apertures 601, 603, 604, and 606 have disposed therein a rotatable carrier having a cylindrical lens secured thereto. Similarly, at least one, and preferably two or more of apertures 701, 703, 704, and 706 have disposed therein a rotatable carrier having a cylindrical lens secured thereto. The remaining apertures can be filled with other filters including, for example, color filters, diffusion filters, lenticular lenses, and patterned media. These filters may, or may not, be mounted in rotatable carriers. One of the apertures in each wheel, however, should be left empty so that the light beam could be allowed to pass unaltered from the color system.

Each of the wheels 60 and 70 has a pair of motors associated therewith, one for rotating its respective wheel (60 or 70) and one for rotating the rotatable carriers disposed in its respective wheel (60 or 70). In this manner, each wheel (60 or 70) can be rotated to align any one of its apertures with the light beam via one corresponding motor, and, when aligned with the light beam, the rotatable carrier can be rotated by the other corresponding motor.

The use of a cylindrical lens introduces an astigmatism into a light beam passing through the lens, with the amount of astigmatism being dictated by the focal length of the lens. As one of ordinary skill in the art will appreciate, a shorter focal length produces a wider ellipse, whereas a larger focal length produces a narrower ellipse. Preferably, at least one of the cylindrical lenses of the wheel 60 has a different focal length from at least one of the lenses of the wheel 70, so that a wide variety of beam shapes can be generated by passing a light beam through two cylindrical lenses having different focal lengths. Most preferably, the set of cylindrical lenses in the wheel 60 have the same focal lengths as the set of cylindrical lenses in the wheel 70. For example, the first wheel 60 may include one empty aperture, one aperture having a rotatable lens with a 100 mm focal length, one aperture have a rotatable lens with a 150 mm focal length, and one aperture having a lenticular lens, and the second wheel 70 might include two empty apertures, one aperture having a rotatable lens with a 100 mm focal length, and one aperture have a rotatable lens with a 150 mm focal length. Although cylindrical lenses are preferred, other types of asymmetrical lenses could alternatively be used.

Figure 4:
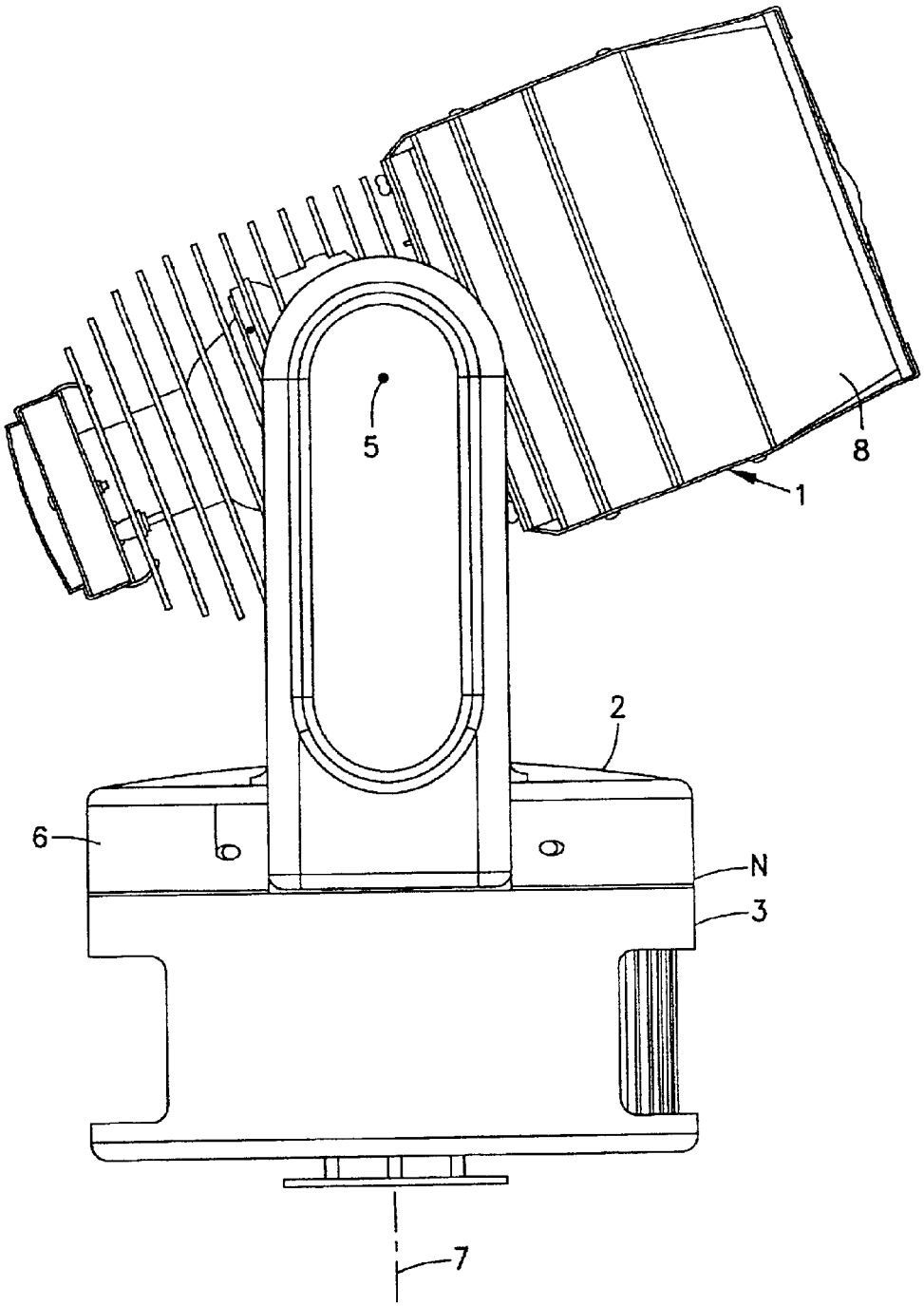
FIG. 4 is a side view of the light projector of FIG. 1(*a*) mounted within a yoke assembly in accordance with a preferred embodiment of the present invention.
Figure 5:
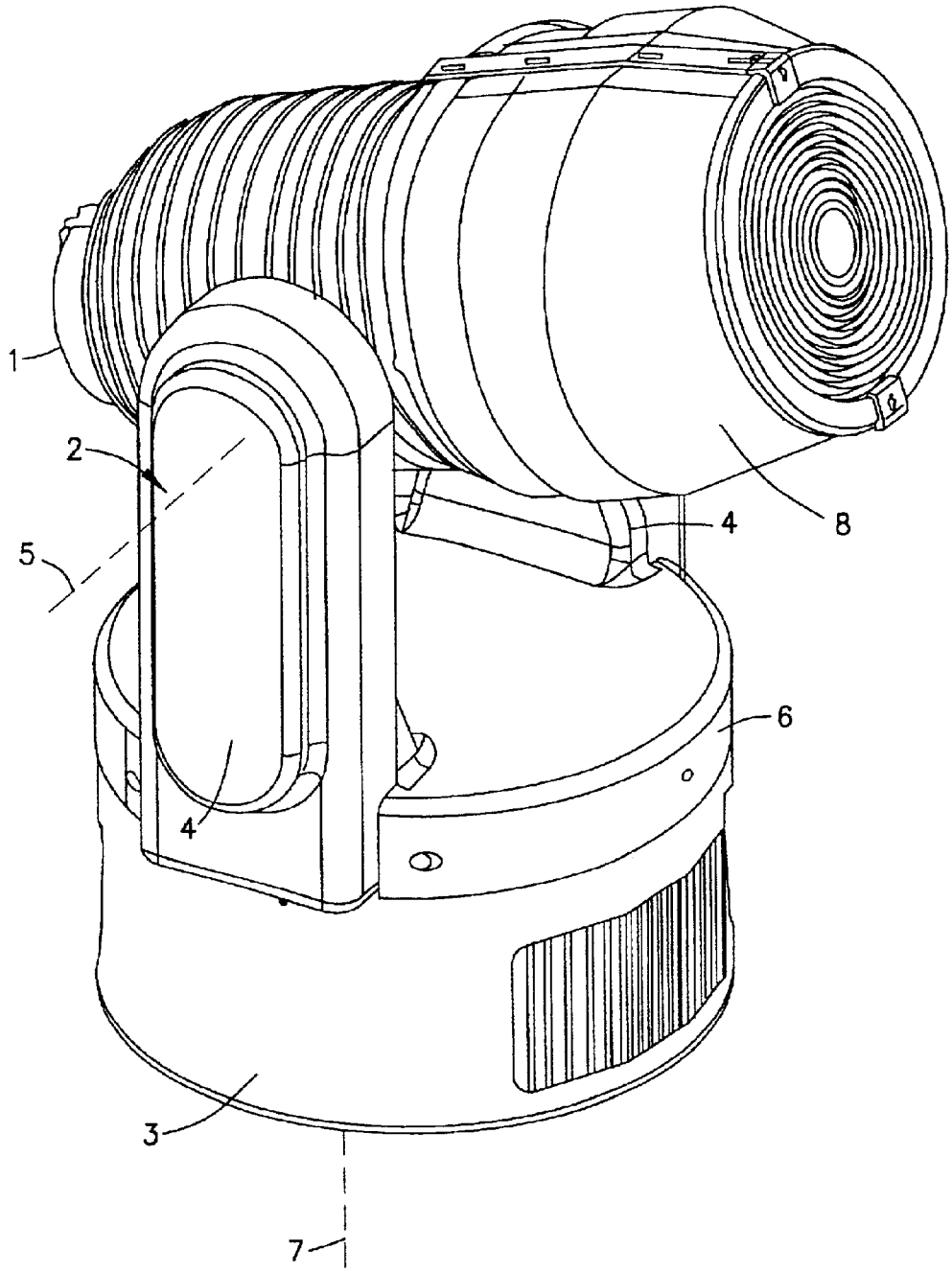
FIG. 5 is a front perspective view of the light projector of FIG. 4.
Figure 6:
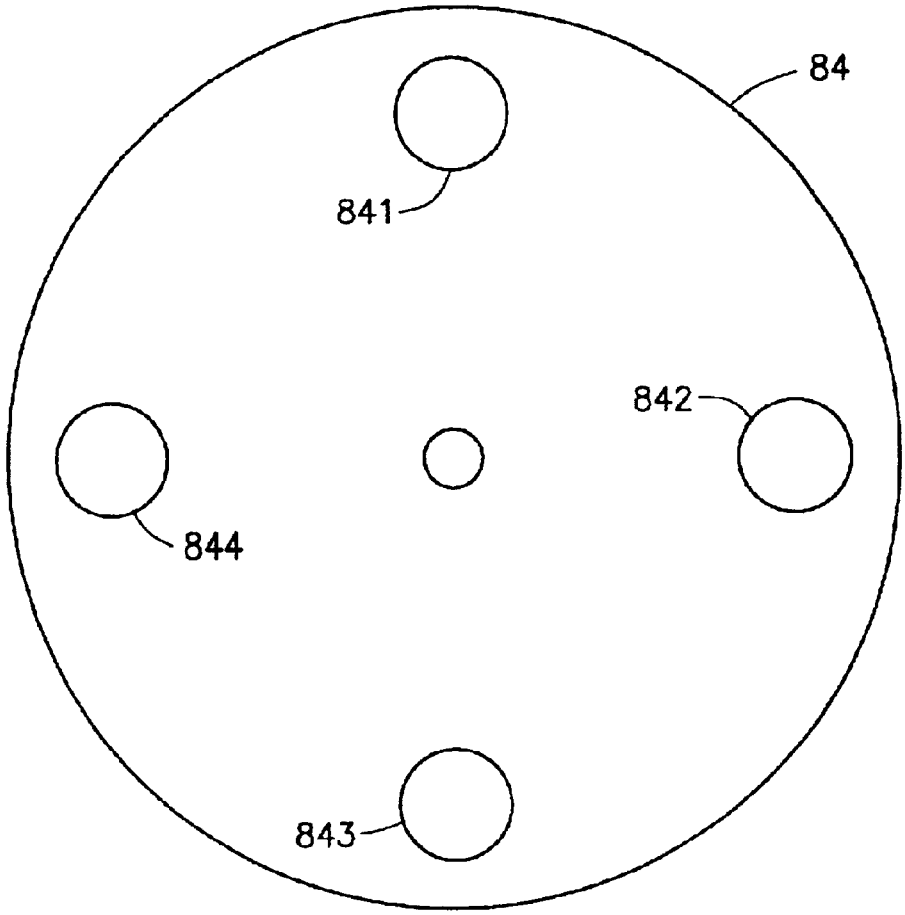
FIG. 6 is a strobe wheel for the light projector of FIGS. 1(*a*) through 5
Figure 7A:
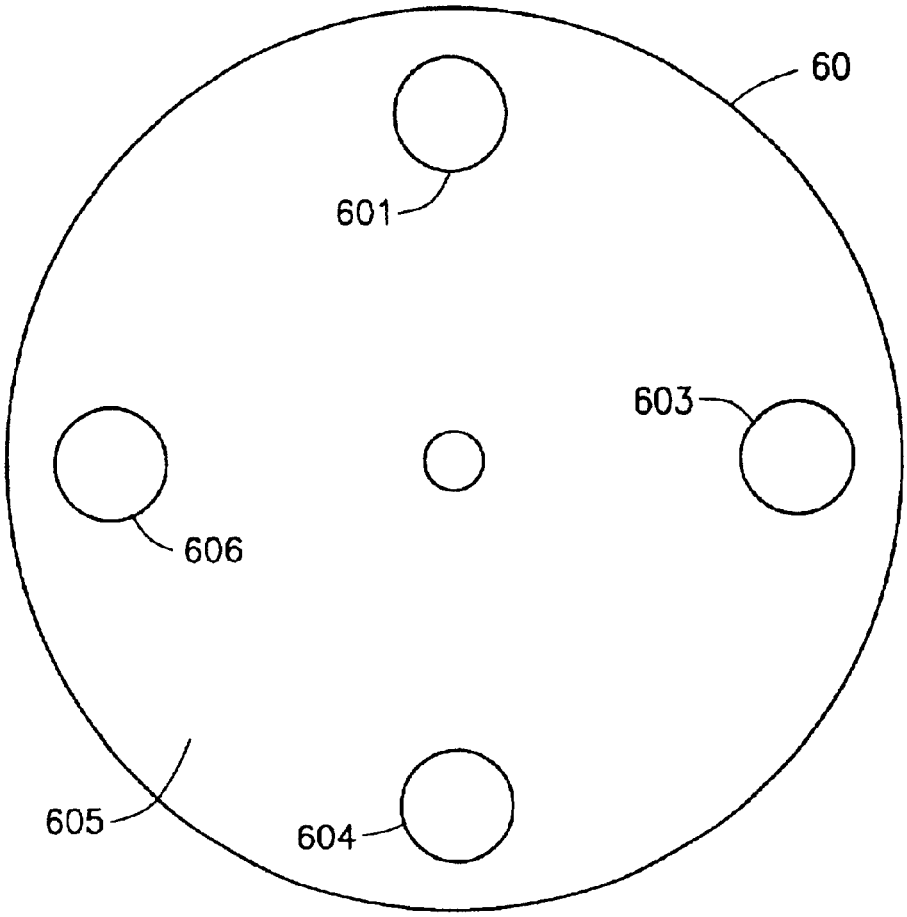
FIG. 7(*a*) illustrates a first lens carrying wheel for the light projector of FIGS. 1(*a*) through 5.
Figure 7B:
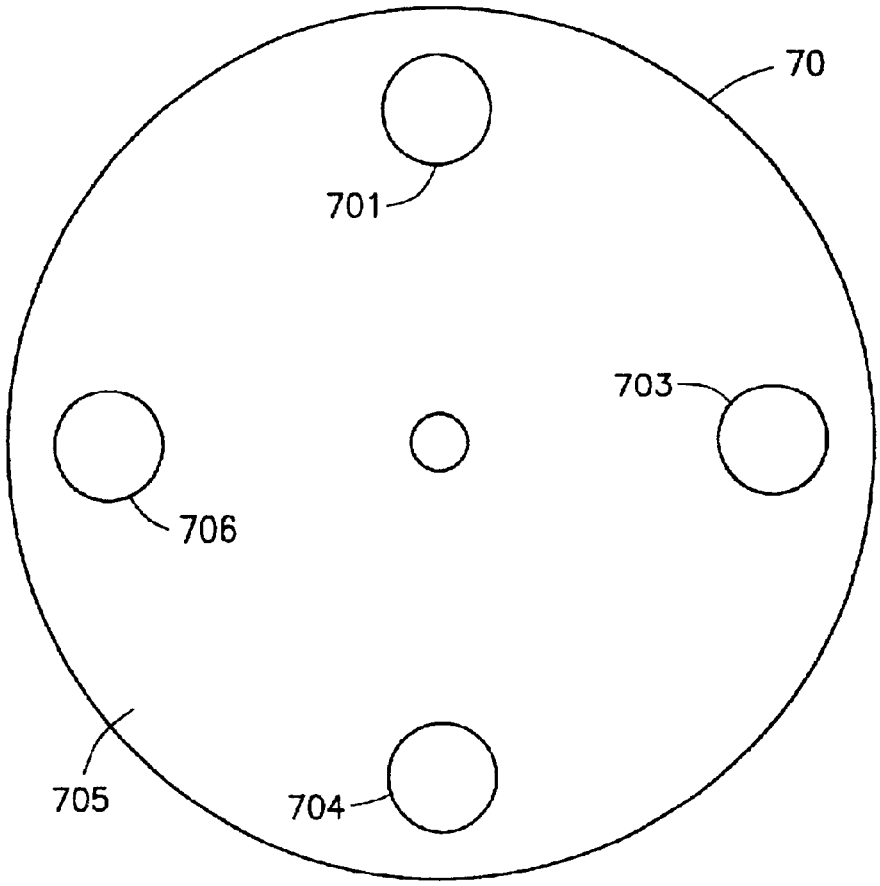

Referring to FIGS. 4 and 5, the light projector 1 is supported in a yoke 2 which, in turn, is mounted on a base 3. The yoke 2 has a pair of vertically extending arms 4 which are coupled to the light projector 1 for moving the projector 1 about the axis 5 (e.g. in a tilting motion), as illustrated in FIGS. 1(*b*), 4, and 5. The yoke 2 also includes a horizontal portion 6 for rotating the projector about the axis 7 (e.g., in a panning motion). The horizontal portion 6 has a diameter which is substantially equal to the diameter of the base portion, as compared to conventional yokes which generally have a substantial gap between the horizontal portion and the base. This design provides the advantage of allowing the use of a larger bearings for rotating the projector about axis 7 than conventional yokes. Preferably, the vertically extending arms 4, the horizontal portion 6, the base portion 3, and the projector housing 8 are fabricated from carbon fiber composite material. Carbon fiber composite material is preferred because of its high strength to weight ratio, and its durability. Preferably, horizontal portion 6 and base 3 have a circular outer surface as shown.

Although the light projector illustrated in FIGS. 1–7 utilizes a fresnel lens, it should be appreciated that alternative lenses may also be used. For example, the lens 90 could be a pebble convex lens. Alternatively, diffusion could be introduced between the beam shaping system 400 and the lens 90, and the lens 90 could be a plano convex lens.

In accordance with another embodiment of the present invention, an apparatus for varying beam size is provided. The beam size change is effected by the gradual introduction of an optical element (lens, frost, diffraction grating, etc) from completely out of the optical path to completely in and normal (90 degrees) to the optical path. In accordance with this embodiment, the optical element is comprised of a plurality of optical sections or sub-elements. Preferably, the optical sub-elements are radial sections of the optical element (e.g., radial sections of a lens). Although the apparatus may include only two optical sub-elements, the use of at least three optical sub-elements is preferred. As the number of sub-elements is increased, the transition in beam size becomes smoother.

The beam size apparatus in accordance with this embodiment provides a visual effect that is different than prior art techniques. Prior art lighting projectors vary the beam size in a number of established ways. The most commonly used methods are: interchanging lenses, moving lenses relative to the light source, moving the light source relative to the reflector, and varying the shape of the reflector. With these methods, as the beam width gradually gets bigger, the intensity across the beam gets smaller as the same number of lumens are spread over a larger area.

With the beam size apparatus in accordance with the above-referenced embodiment of the invention, the optical path distances and shapes are fixed. As the optical sub-elements enter the beam, some rays of light instantly go to the maximum beam size. The intensity of the beam is then gradually redistributed from the smaller beam path to the maximum beam path. The beam begins at its smallest size, and as soon as the leading portion of the optical sub-elements enter the optical path, some small number of rays are visible at the maximum size, but with most of the intensity remaining centered in the original beam size. As the sub-elements progressively intersect more of the beam, the intensity shifts from the original small beam size to a more evenly distributed displacement across the larger beam size. Instead of the projected spot gradually getting bigger as in prior art techniques, in this method the projected spot instantly appears at its maximum size, while the intensity progressively shifts from the center to a more Guassian distribution across the projected spot.

Figure 8A:
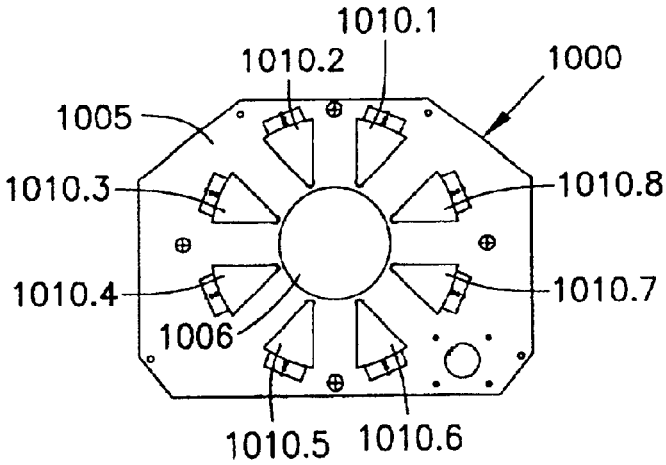
FIGS. 8(*a*) through 8(*c*) show a beam size apparatus in accordance with an embodiment of the present invention positioned to project light with a minimum beam width.
Figure 8B:
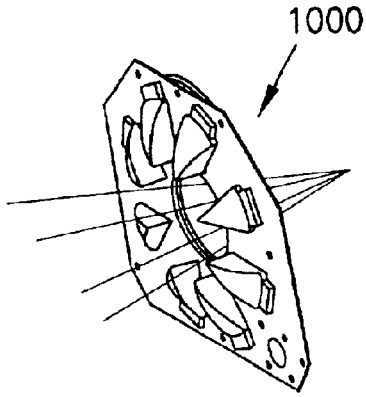
Figure 8C:
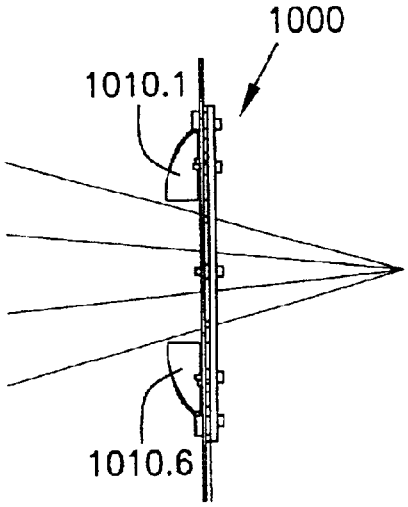

FIGS. 8(*a*) through 10(*c*) show a variable beam-size apparatus 1000 in accordance with a preferred embodiment of the present invention. FIGS. 8(*a*) through 8(*c*) show the apparatus positioned to project light with a minimum beam width, FIGS. 10(*a*) through 10(*c*) show the apparatus positioned to project a maximum beam width, and FIGS. 9(*a*) through 9(*c*) show the apparatus positioned such that a portion of the beam projects at the maximum beam width.

The apparatus 1000 includes a base 1005 having an opening 1006 formed therein. A beam of light 1007 from a light source (not shown) passes through the opening 1006. A piano convex lens 1010 divided into eight lens sub-elements 1010.1 through 1010.8 is movably mounted to the base 1005. In the preferred embodiment shown in FIGS. 8(*a*) through 10(*c*), the lens sub-elements 1010.1 through 1010.8 move in a plane parallel to the opening 1006. Put another way, the lens sub-elements move in a direction substantially perpendicular to the beam 1007 passing through the opening 1006. In this regard, the term "substantially perpendicular" is used because, in the embodiment shown, the light entering the opening 1006 is not collimated, and therefore, not all of the rays in the beam will be precisely perpendicular to the face of the base 1005. As illustrated the lens sub-elements are radial sub-elements or sections of the overall lens 1010.

In the embodiment illustrated in FIGS. 8(*a*) through 10(*c*), the lens sub-elements 1010.1–1010.8 are mounted in tracks 1020, and moved along the tracks 1020 under the control of one or more motors. In the illustrated embodiment, the tracks are formed through the base 1005, with gears and/or pulleys mounted on the opposite face of the base (not shown). Although it is possible to drive each lens sub-element via a separate motor, synchronization of movement is simplified if a single motor is used, and coupled to the lens sub-elements via gears or pulleys. In the illustrated embodiment, the tracks 1020 are formed through the base 1005, with gears and/or pulleys mounted on the opposite face of the base (not shown) It should be appreciated, moreover, that alternative mechanisms for moving the lens sub-elements parallel to the opening 1006 can also be used, including, for example, pistons, guide rails, etc. Moreover, independent and/or asynchronous movement of the sub-elements (e.g., via independent motors) may also be provided if, for example, a beam shaping effect is desired.

It should also be appreciated that the lens sub-elements need not move parallel to the opening 1006. Rather, alternative movements can be used to bring the sub-elements in and out of the path of the beam 1007. For example, each lens sub-element could be pivotably mounted to the base 1005 via a hinge so that the lens sub-element can be gradually brought into the path of the beam. Moreover, all of the lens sub-elements need not be moved in the same manner. For example, some sub-elements could be mounted on hinges, with the remaining sub-elements being moved parallel to the opening 1006.

In any event, turning to FIGS. 8(*b*) and 8(*c*), it can be seen that when the lens sub-elements 1010.1–1010.8 are in a fully retracted position the beam 1007 passes through the apparatus 1000 unaltered, thereby projecting a beam with a minimum beam width.

Figure 10A:
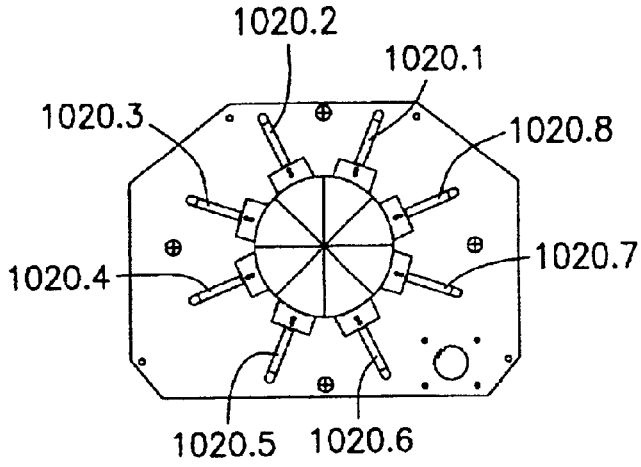
FIGS. 10(*a*) through 10(*c*) show the apparatus of FIGS. 8(*a*) through 8(*c*) positioned to project a maximum beam width.
Figure 10B:
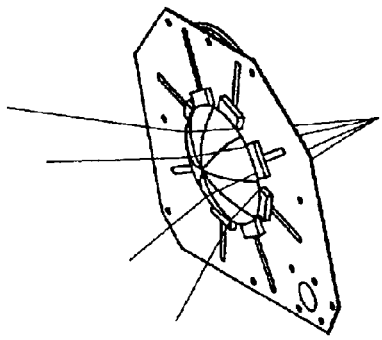
Figure 10C:
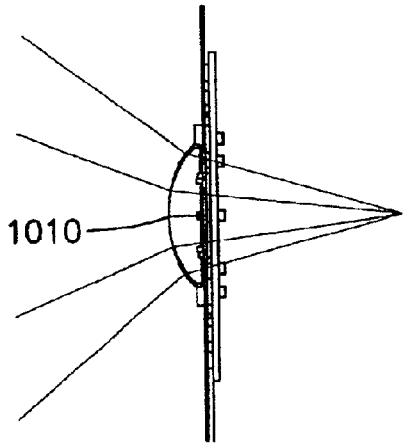
Figure 11:
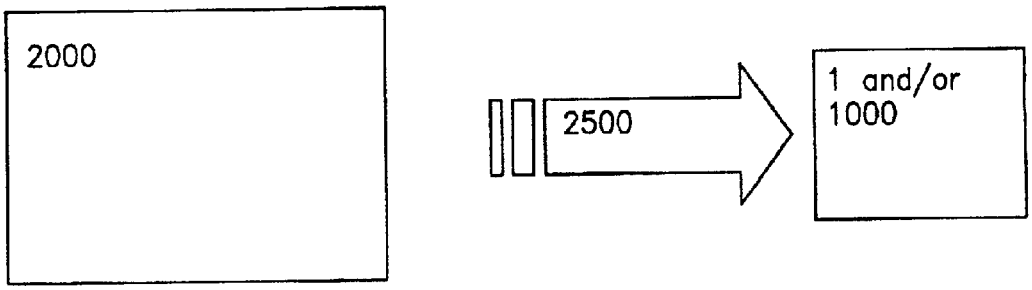
FIG. 11 shows an automated lighting system.

Conversely, when the lens elements 1010.1–1010.8 are in an unretracted position as shown in FIGS. 10(*b*) and 10(*c*), substantially all of the light passing through the opening 1007 impinges upon (and therefore is refracted by) the plano convex lens sub-elements, thereby projecting a beam with a maximum beam width. Preferably, this is achieved by having adjacent lens sub-elements in contact with each other. In the context of the present invention, however, even if the lens sub-elements are not in contact with each other, substantially all of the light impinges upon the lens sub-elements if the lens sub-elements are sufficiently close to each other that, when viewed by a naked human eye in its intended environment of use (for example., from the audience in a theatrical production), the projected beam appears the same as a projected beam generated by the lens sub-elements when they are in contact with each other.

Figure 9A:
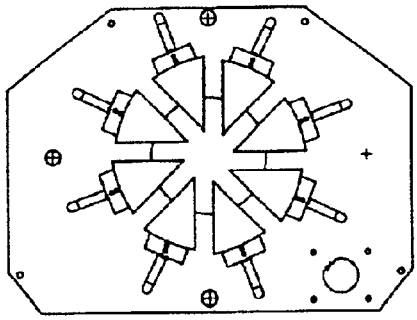
FIGS. 9(*a*) through 9(*c*) show the apparatus of FIGS. 8(*a*) through 8(*c*) positioned such that a portion of the beam projects at the maximum beam width.
Figure 9B:
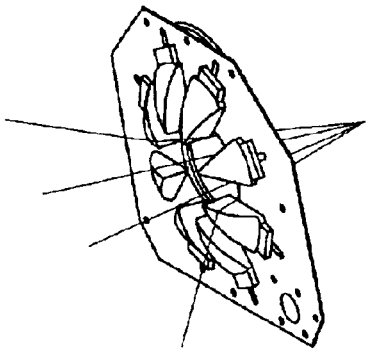
Figure 9C:
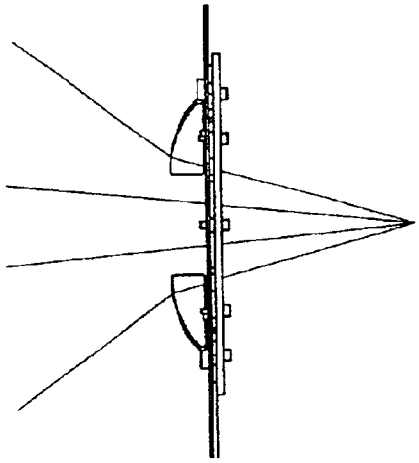

Turning now to FIGS. 9(*b*) and 9(*c*), when the lens sub-elements 1010.1 through 1010.8 are positioned in an intermediate position between the retracted and unretracted positions, the portion of the beam 1007 that impinges upon the lens sub-elements are refracted to the maximum beam width while the remaining portion of the beam passes through the opening 1007 unaltered. Although only one intermediate position is shown in FIG. 9, it should be understood that the lens sub-elements may be moved gradually from the retracted to unretracted positions under motor control.

In the arrangement of FIGS. 8–10, the lens element is comprised of eight radially sectioned sub-elements 1010.1 through 1010.8. However, it should be noted that greater or fewer lens sub-elements can be used (e.g. 2, 3, 4, 12, 15, 24, 32, etc).

While the embodiment of FIGS. 8–10 is illustrated with a plano convex lens, it should be appreciated that other types of optical elements could alternatively be used. Examples of possible types of optical elements include a double-convex lens, plano-concave lens, double-concave lens, aspheric lens, condenser lens, fresnel lens, meniscus lens, lenticular arrays, ground glass lens, diffusing lens, diffraction grating, frosted material or a polarizing lens. It should also be appreciated that more than one beam size apparatus 1000 may be included in a light projector. For example, a light projector could include a first beam size apparatus having a plurality of plano convex lens sub-elements and a second beam size apparatus having a plurality of frosted material sub-elements.

In accordance with further embodiments of the present invention, the beam size apparatus of FIGS. 8(*a*) through 10(*c*) may be included as a sub-assembly in the projector 1 of FIGS. 1–7. Preferably, the apparatus 1000 replaces the translating light pipe 40. In general, the apparatus 1000 can be placed anywhere between the central passage 25 and the lens 90.

As one of ordinary skill in the art will appreciate, the projector 1 of FIGS. 1 through 7 and/or the apparatus 1000 of FIGS. 8 through 10 may form part of an automating lighting system including a remote control console that remotely controlling the movement of the various motors described above. Such an automated lighting system is illustrated schematically in FIG. 11. The connection between the remote control console 2000 and the projector 1 and/or apparatus 1000 may comprise any suitable transmission medium 2500, including, for example, electrical cables, data transmission cables, and wireless transmission techniques. The remote control console 2000 may, for example, be of any type conventionally used in the art for controlling the movement of automated lighting fixtures.

What is claimed is:

1. A light projector comprising: a light source projecting a beam of light; an optical element movable between a first position in which the beam of light does not impinge upon the optical element, a second position in which substantially all of the beam of light impinges upon the optical element, and a plurality of intermediate positions in which a portion of the beam of light impinges upon the optical element, wherein the optical element is comprised of a plurality of radially sectioned sub-elements, and wherein the plurality of sub-elements are radial sections of a plano convex lens.

2. The light projector of claim 1, wherein the plurality of sub-elements, when in the second position, together form a circular plano convex lens.

3. The light projector of claim 2, wherein the plurality of sub-elements includes eight sub-elements.

4. A light projector comprising: a light source projecting a beam of light; an optical element movable between a first position in which the beam of light does not impinge upon the optical element, a second position in which substantially all of the beam of light impinges upon the optical element, and a plurality of intermediate positions in which a portion of the beam of light impinges upon the optical element, wherein the optical element is comprised of a plurality of radially sectioned sub-elements, and, further including a base having an opening formed therein, wherein the beam of light passes through the opening, and wherein the optical sub-elements are movably secured to the base.

5. The light projector of claim 4, wherein the optical sub-elements are movable between the first, second and intermediate positions in a direction parallel to a face of the opening.

6. A light projector comprising: a light source projecting a beam of light; an optical element movable between a first position in which the beam of light does not impinge upon the optical element, a second position in which substantially all of the beam of light impinges upon the optical element, and a plurality of intermediate positions in which a portion of the beam of light impinges upon the optical element, wherein the optical element is comprised of two radially sectioned sub-elements.

7. A light projector comprising: a light source projecting a beam of light; an optical element movable between a first position in which the beam of light does not impinge upon the optical element, a second position in which substantially all of the beam of light impinges upon the optical element, and a plurality of intermediate positions in which a portion of the beam of light impinges upon the optical element, wherein the optical element is comprised of three radially sectioned sub-elements.

8. The light projector of claim 4, wherein the plurality of sub-elements are plano convex lens sub-elements.

9. The light projector of claim 8, wherein the plurality of sub-elements, when in the second position, together form a circular plano convex lens.

10. The light projector of claim 9, wherein the plurality of sub-elements includes eight sub-elements.

11. The light projector of claim 4 wherein the optical element is selected from the group consisting of double-convex lens, plano-concave lens, double-concave lens, aspheric lens, condenser lens, fresnel lens, meniscus lens, lenticular arrays, ground glass lens, diffusing lens, diffraction grating, frosted material and a polarizing lens.

12. A light projector comprising: a light source projecting a beam of light; a plurality of optical sub-elements each movable between a first position in which the beam of light does not impinge upon the optical sub-element, a second position in which substantially all of the beam of light impinges upon the optical sub-element, and a plurality of intermediate positions in which a portion of the beam of light impinges upon the optical sub-element, wherein the plurality of sub-elements are plano convex lens sub-elements.

13. The light projector of claim 12, wherein the plurality of sub-elements, when in the second position, together form a circular plano convex lens.

14. The light projector of claim 13, wherein the plurality of sub-elements includes eight sub-elements.

15. A light projector comprising: a light source projecting a beam of light; a base having an opening formed therein, the beam of light positioned to pass through the opening; a plurality of optical sub-elements movably secured to the base, each sub-element movable between a first position in which the beam of light does not impinge upon the optical sub-element, a second position in which substantially all of the beam of light impinges upon the optical sub-element, and a plurality of intermediate positions in which a portion of the beam of light impinges upon the optical sub-element.

16. The light projector of claim 15, wherein the optical sub-elements are movable between the first, second and intermediate positions in a direction parallel to a face of the opening.

17. The light projector of claim 15, wherein the optical sub-elements are movable between the first, second and intermediate positions in a direction substantially perpendicular to the beam of light passing through the opening.

18. The light projector of claim 15, wherein the plurality of sub-elements are plano convex lens sub-elements.

19. The light projector of claim 15, wherein the plurality of sub-elements, when in the second position, together form a circular plano convex lens.

20. The light projector of claim 19, wherein the plurality of sub-elements includes eight sub-elements.

21. The light projector of claim 15 wherein the optical sub-elements are selected from the group consisting of double-convex lens, plano-concave lens, double-concave lens, aspheric lens, condenser lens, fresnel lens, meniscus lens, lenticular arrays, ground glass lens, diffusing lens, diffraction grating, frosted material and a polarizing lens.

22. The light projector of claim 12, wherein the light projector is a wish light.

23. The light projector of claim 1, further comprising one or more motors, the optical sub-elements movable via the one or more motors.

24. The light projector of claim 12, further comprising one or more motors, the optical sub-element movable via the one or more motors.

25. The light projector of claim 15, further comprising one or more motors, the optical sub-element movable via the one or more motors.

26. A beam size sub-assembly comprising: a base having an opening formed therein; a plurality of optical sub-elements movably secured to the base, each sub-element movable between a first position in which a beam of light passing through the opening does not impinge upon the optical sub-element, a second position in which substantially all of the beam of light impinges upon the optical sub-element, and a plurality of intermediate positions in which a portion of the beam of light impinges upon the optical sub-element.

27. The light projector of claim 1, further comprising: a second optical element disposed between the light source and the optical element, the second optical element movable between a first position in which the beam of light does not impinge upon the second optical element, a second position in which substantially all of the beam of light impinges upon the second optical element, and a plurality of intermediate positions in which a portion of the beam of light impinges upon the second optical element, wherein the second optical element is comprised of a plurality of radially sectioned sub-elements.

28. The light projector of claim 23, further comprising a remote control console, and wherein the motor is controlled via the remote control console.

29. The light projector of claim 24, further comprising a remote control console, and wherein the motor is controlled via the remote control console.

30. The light projector of claim 25, further comprising a remote control console, and wherein the motor is controlled via the remote control console.

31. The light projector of claim 4, wherein the optical sub-elements are movable between the first, second and intermediate positions in a direction substantially perpendicular to the beam of light passing through the opening.

* * * * *